United States Patent [19]

Koyama et al.

[11] Patent Number: 4,486,841

[45] Date of Patent: Dec. 4, 1984

[54] BENDING PRESS

[75] Inventors: Katsumi Koyama, Hiratsuka; Shigenori Kojima, Tokyo; Tsuneo Kogure, Hatano; Naoaki Itano; Yoshihiko Ohashi, both of Machida, all of Japan

[73] Assignee: Amada Company, Limited, Japan

[21] Appl. No.: 328,601

[22] Filed: Dec. 8, 1981

[30] Foreign Application Priority Data

Dec. 9, 1980 [JP] Japan ..... 55-172571
Dec. 15, 1980 [JP] Japan ..... 55-177001
Dec. 15, 1980 [JP] Japan ..... 55-177002

[51] Int. Cl.[3] ..... G06F 15/46; B21D 5/02

[52] U.S. Cl. ..... 364/474; 72/21; 72/389; 364/167; 364/476

[58] Field of Search ..... 364/476, 474, 475, 167–171; 72/8, 21, 22, 36, 389, 441, 461, 26, 30; 318/39

[56] References Cited

U.S. PATENT DOCUMENTS 3,165,140 1/1965 Hazelton et al. .
3,485,071 12/1969 Jones, Jr. ..... 72/26
3,618,349 3/1969 Roch ..... 364/476
3,824,822 7/1974 Richardson ..... 72/36
3,826,119 7/1974 Marotto ..... 72/461 X
3,874,205 4/1975 Roch et al. ..... 72/8
4,074,350 2/1978 Roch et al. ..... 364/474 X
4,115,859 9/1978 Brisk et al. ..... 364/476
4,148,203 4/1979 Farazandeh et al. ..... 72/21 X
4,282,738 8/1981 Kojima et al. ..... 72/389

*Primary Examiner*—Joseph F. Ruggiero
*Attorney, Agent, or Firm*—Wigman & Cohen

[57] ABSTRACT

In a bending press, the stroke length of a ram member is automatically set based upon conditions such as the angle to be made on a workpiece, the width and configuration of a groove in a lower tool, and the thickness, width and tensile strength of the workpiece. There is also an input device into which the bending conditions are set and a computer for calculating the stroke length of the ram member which is then automatically adjusted. A device for detecting deflections occurring in an overhead beam in the bending press is connected to the computer to compensate for the stroke lengths of the ram member. The press accurately and easily bends sheet-like workpieces into various shapes including those cylindrical and semicircular in cross section.

9 Claims, 13 Drawing Figures

BENDING PRESS

BACKGROUND OF THE INVENTION

1. Field of the Invention

The present invention relates generally to bending presses generally referred to as press brakes used to bend sheet-like workpieces such as sheet metals. More particularly the present invention pertains to methods and apparatuses for accurately and easily bending sheet-like workpieces into various shapes including those channel-like and semicircular in cross section.

2. Description of the Prior Art

As is well-known, bending presses or press brakes for bending sheet-like workpieces such as sheet metals comprise a pair of long bar-like upper and lower tools or dies which are horizontally disposed in vertical alignment with each other. The upper tool is formed at its lower surface with a horizontally extending bending portion which is generally V-shaped in cross section but is often formed otherwise. The lower tool is formed at its top surface with a horizontal groove which is also generally V-shaped in cross section but is often formed otherwise. Also, either of the upper and lower tools is horizontally fixed to a fixed beam member, and the other is horizontally carried by a movable beam-like ram member which is power driven vertically by a suitable means such as a hydraulic motor. Of course, the bending portion of the upper tool and the groove of the lower tool are in vertical alignment with each other so that they may be brought into and out of engagement with each other when the ram member is vertically moved. Thus, in operation, a workpiece to be bent is horizontally placed on the lower tool and then the ram member is moved by power to make the bending portion of the upper tool contact the workpiece and then press the workpiece into the groove of the lower tool.

In the above described arrangement, the workpiece is bent into the shape of the groove of the lower tool if it is fully pressed thereinto by the bending portion of the upper tool which has been formed similar to the groove of the lower tool. However, in what is called air bending by use of the upper tool which is V-shaped, the workpiece is bent to various angles depending upon the depths by which the bending portion of the upper tool is brought into the groove of the lower tool. In other words, the workpiece can be bent to any angle by the air bending without changing the upper and lower tools by adjusting the stroke length of the ram member to adjust the entry of the bending portion of the upper tool into the groove of the lower tool, namely, by the pressure of the upper tool onto the workpiece. Of course, the workpiece can be bent several times by the air bending to be formed into various shapes having several folds of various angles by repeatedly stroking the ram member with the stroke length adjusted. Also, it could be possible in air bending to bend the workpiece into a semicylindrical shape which is semicircular in cross section by repeatedly stroking the ram member with the stroke length adjusted and forwardly moving the workpiece by a slightest equal distance after each stroke of the ram member.

In bending presses, it is very important to accurately adjust and set the stroke length of the ram member in order to accurately bend the workpiece to desired angles as has been described above, since in fact a slight error in adjusting the stroke length of the ram member will result in poor bending. Also, it is essentially necessary to adjust and set the stroke length of the ram member not only according to the bending angle to be made on the workpiece but also based upon other conditions such as the width and configuration of the groove of the lower tool, the thickness, width and tensile strength of the workpiece to be bent. Furthermore, it is likewise necessary in adjusting and setting the stroke length of the ram member to take into account the deflections of the ram member which will inevitably occur because of the bending force during bending operations and will produce an influence on the stroke length of the ram member.

Heretofore, however, there has been neither method nor means for accurately adjusting and setting the stroke length of the ram member in bending presses. Above all things, it has been conventionally virtually impossible to accurately find out or measure the thickness and the tensile strength of workpieces to be bent, since the workpieces are delicately different in thickness and tensile strength even if they have been produced as an identical lot. Also, there has been no means for effectively detecting the deflections of the bending presses and compensating the stroke length of the ram member for such deflections. Such being the case, heretofore, it has been customary that the stroke length of the ram member is adjusted and set by trial and error by experimentally bending the workpieces until an acceptable bend is obtained. Accordingly, a great deal of skill has been required to adjust and set the stroke length of the ram member and the fact has been that a number of workpieces will be scrapped before an acceptable stroke length is obtained. Nevertheless, it has been impossible in any event to make really accurate bending operations by adjustng and setting the stroke length of the ram member in the conventional manner, since the workpieces are different in thickness and tensile strength and will produce changes in the bending force.

As another major conventional disadvantage with regard to bending presses, it has been impossible to easily and accurately bend workpieces by use of a single pair of upper and lower tools into cylindrical shapes which are semicircular in cross section. In order to bend a workpiece into a cylindrical shape by use of a single pair of upper and lower tools, it is necessary to repeatedly stroke the ram member with the stroke length adjusted at each stroke and forwardly move the workpiece by a slightest equal distance after each stroke. However, it has been virtually impossible to accurately adjust and set the stroke length of the ram member as has been described hereinbefore, and furthermore it has been impossible to accurately set the distance by which a workpiece to be bent is forwardly moved after each stroke of the ram member so that the workpiece is bent into a semicylindrical shape.

SUMMARY OF THE INVENTION

It is a general object of the present invention to provide methods and apparatuses for accurately and easily bending sheet-like workpieces by use of a single pair of upper and lower tools in bending presses into various shapes having various bent angles and including semicylindrical shapes which are semicircular in cross section.

It is a specific object of the present invention to provide a method and apparatus for automatically adjusting and setting the stroke length of the ram member by which the upper tool is brought into the groove of the lower tool to press a workpiece to be bent thereinto in bending presses.

It is another specific object of the present invention to provide a method and apparatus for detecting the deflections produced by the bending force during bending operations in bending presses and compensating the stroke length of the ram member for such deflections.

It is another object of the present invention to provide a method and apparatus for automatically setting the distance by which a workpiece to be bent is forwardly moved or fed after each stroke of the ram member in bending presses so that the workpiece is bent into a semicylindrical shape which is semicircular in cross section.

According to the present invention, the stroke length of the ram member is automatically set based upon bending conditions such as the bending angle to be made on workpieces, the width and configuration of the groove of the lower tool, and the thickness, width and tensile strength of workpieces to be bent. More particularly, a bending press according to the present invention is provided with an input means into which the bending conditions are set, a computing means for computing the stroke length of the ram member based upon the bending conditions set in the input means and an adjusting means for automatically adjusting the stroke length of the ram member under the control of the computing means. Also, a detecting means for detecting the deflections occurring in the bending press, is connected to the computing means to compensate the stroke length of the ram member for the detected deflections. Thus, the stroke length of the ram member is also compensated for the differences of the workpieces in thickness and tensile strength which will have effects on the bending force causing the deflections in the bending press. Furthermore, when workpieces are to be bent into cylindrical shapes, the distance by which the workpieces are forwardly moved or fed is also simultaneously set based upon the bending conditions set in the input means.

Other and further objects and advantages of the present invention will be apparent from the following description and accompanying drawings which, by way of illustration, show preferred embodiments of the present invention and the principles thereof.

DESCRIPTION OF THE PREFERRED EMBODIMENTS

Figure 1:
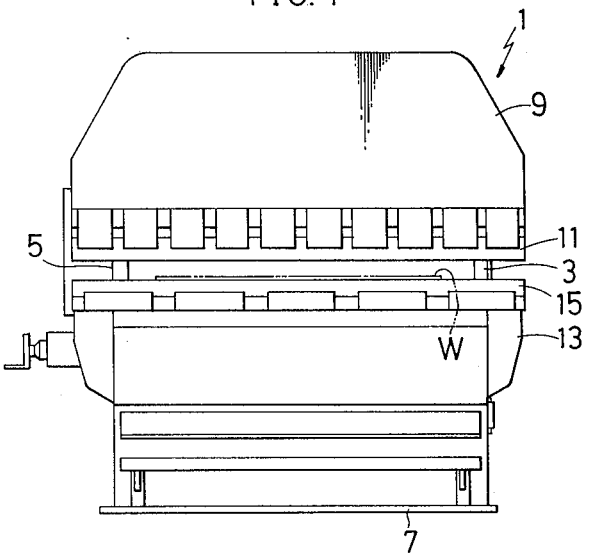
FIG. 1 is a front view of a bending press or hydraulic press brake embodying the principles of the present invention.
Figure 2:
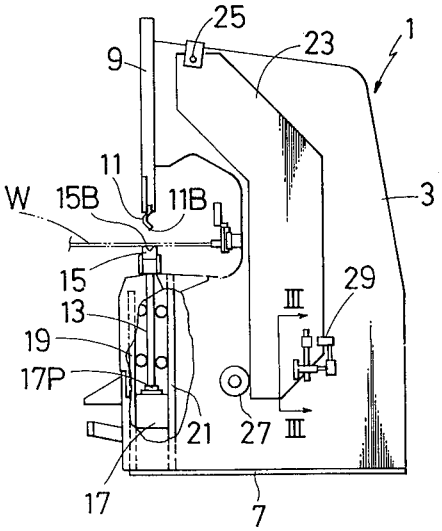
FIG. 2 is a right side view showing the bending press shown in FIG. 1.

Referring now to FIGS. 1 and 2, there is shown a bending press 1 which is often referred to as press brake and is used mainly to bend sheet-like workpieces such as sheet metals into shapes such as angles and channels. The bending press 1 comprises a pair of C-shaped upright plates 3 and 5 which are vertically disposed in parallel with each other and are integrally connected with each other by a base plate 7 at their lower ends. The bending press 1 also comprises a horizontal overhead beam member 9 integrally connecting the upper ends of the upright plates 3 and 5 and holding a bar-like upper tool 11 and further comprises a beam-like ram member 13 holding a bar-like lower tool 15 on which a workpiece W to be bent is horizontally placed. The upper tool 11 is horizontally and detachably fixed to the lower end of the beam member 9 and it is formed at its lower end with a horizontal elongate bending portion 11B which is generally V-shaped in cross section. Also, the lower tool 15 is horizontally and detachably mounted on the top end of the ram member 13 and it is formed at its top surface with a horizontal groove 15B which is generally V-shaped in cross section.

As best seen from FIG. 2, the ram member 13 holding the lower tool 15 is vertically movably disposed in vertical alignment with the beam member 9 so that the groove 15B of the lower tool 15 can be brought into engagement with the bending portion 11B of the upper tool 11 when the ram member 13 is raised. More specifically, the ram member 13 is so arranged as to be vertically moved toward and away from the beam member 9 by a hydraulic motor 17 or motors having a piston rod **17*p* between a front plate 19 and a rear plate 21 which are vertically disposed beneath the beam member 9. The front and rear plates 19 and 21 are fixedly provided in parallel with each other before and behind the ram member 13, respectively, to connect the lower portions of the upright plates 3 and 5, and they are provided with guide means for the vertical movement of the ram member 13. In this arrangement, when the ram member 13 is raised by the hydraulic motor 17 or motors, the lower tool 15 will be raised by the ram member 13 into engagement with the upper tool 11 in such a manner that the bending portion 11B of the upper tool 11 will be brought into the groove 15B of the lower tool 15. Thus, when the ram member 13 is raised with the workpiece W placed on the lower tool 15 as best shown in FIG. 2, the lower tool 15 will urge the workpiece W toward the upper tool 11 so that the workpiece W may be pressed into the groove 15B of the lower tool 15 by the bending portion 11B of the upper tool 11** to be bent into a shape.

In the above described arrangement, the workpiece W is bent into the shape of the groove 15B of the lower tool 15 if it is fully pressed thereinto by the bending portion 11B of the upper tool 11 which has been formed similar to the groove 15B of the lower tool 15. However, with the upper tool 11 formed V-shaped, the workpiece W can be bent into any angle or shape by the air bending by adjusting the stroke length of the ram member 13 to adjust the entry of the bendng portion 11B of the upper tool 11 into the groove 15B of the lower tool 15. Also, the workpiece W can be bent several times by the air bending to be formed into various shapes having several folds of various angles if it is forwardly moved or fed and the ram member 13 is repeatedly stroked with the stroke length adjusted. Furthermore, the workpiece W can be bent into a semicylindrical shape which is semicircular in cross section if the ram member 13 is repeatedly stroked with the stroke length adjusted and the workpiece W is forwardly moved by a slightest equal distance after each stroke of the ram member 13.

In this connection, it is to be noted that the present invention is not limited in application to the bending press 1 shown in FIGS. 1 and 2 in which the lower tool 15 is held and moved by the ram member 13 toward and away from the upper tool 11 which is fixed. It should be noted that the present invention is also applicable to a bending press in which a lower tool is fixed and an upper tool is so arranged as to be moved by a ram member toward and away from the lower tool.

In the bending press 1 described above, the overhead beam member 9 is subjected to upward deflection because of the bending force during bending operations since the reaction to the bending force will apply a bending moment to the C-shaped upright plates 3 and 5 to cause the gap or throat thereof to upwardly widen or open. Since the bending force changes depending upon bending conditions such as the thickness, width and tensil strength of workpieces to be bent, the deflection of the beam member 9 is also varied depending upon such bending conditions. Thus, it is necessary to detect the deflections of the beam member 9 and compensate the stroke length of the ram member 13 for the detected deflections so as to make accurate bending operations, since the deflections of the beam member 9 will affect the stroke length of the ram member 13.

As best shown in FIG. 2, in order to detect the deflections of the beam member 9, an elongate detecting plate 23 is vertically provided on the outside of the upright plate 3. The detecting plate 23 is pivotally held by means of a hinge pin 25 at the front upper end of the outside of the upright plate 3 in such a manner as to depend downwardly therefrom to the lower portion of the outside of the upright plate 3. Thus, the detecting plate 23 is so arranged as to be moved up and down by the hinge pin 25 along the outside of the upright plate 3 when the front upper end of the upright plate 3 is upwardly deflected and returned to its normal state by the beam member 9 depending upon the bending force. Also, the lower portion of the detecting plate 23 is stopped by a guide roller 27 and a block member 29 from being swung around the hinge pin 25 in such a manner that it can be moved up and down therebetween.

Figure 3:
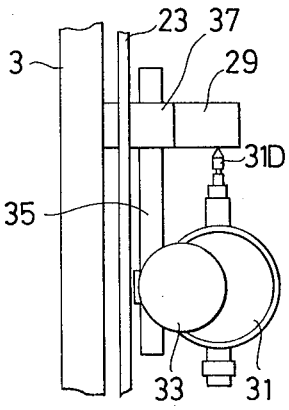
FIG. 3 is an enlarged cross-sectional view of a portion of the bending press shown in FIGS. 1 and 2 and is shown in section taken along line III—III of FIG. 2.
Figure 4:
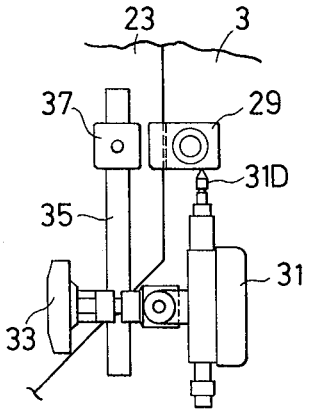
FIG. 4 is a side view showing the same portion as FIG. 3 as viewed from the right-hand side of FIG. 3.

As shown in FIGS. 2, 3 and 4, there is provided on the detecting plate 23 a deflection detector 31 such as a dial gauge or a load monitor which is provided with an upwardly biased detecting member 31D. The deflection detector 31 is vertically adjustably held by a knob 33 on a guide rod 35 which is vertically held by a holding member 37 on the lower portion of the detecting plate 23. The deflection detector 31 is so mounted on the lower portion of the detecting plate 23 that the detecting member 31D which is upwardly biased is vertically held in contact with the underside of the block member 29. Also, the deflection detector 31 is so arranged as to detect the deflection of the beam member 9 when the detecting member 31D is depressed by the block member 29.

In the above described arrangement, the detecting member 31D of the deflection detector 31 will be depressed when the front upper end of the upright plate 3 is deflected by the beam member 9 because of the bending force to raise the detecting plate 23 by means of the hinge pin 25. Thus, it will now be understood that the deflection of the beam member 9 can be detected by the deflection detector 31 by means of the detecting plate 23 when the upright plate 3 is upwardly deflected to bring up the deflection plate 23. Also, the deflection detector 31 is connected to a computing means to compensate the stroke length of the ram member for the deflections of the beam member 9 as will be described in great detail hereinafter. In this connection, it will be readily understood by those skilled in the art that the detecting plate 23 and the deflection detector 31 can be provided on either or both of the upright plates 3 and 5.

Figure 5:
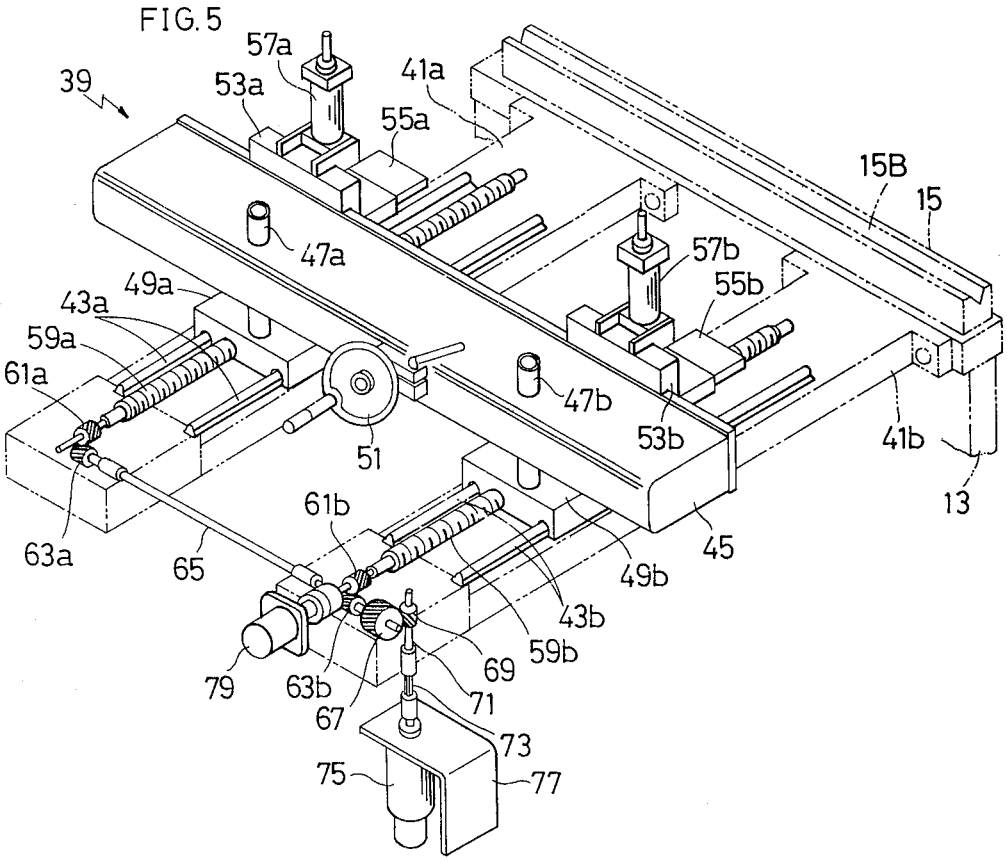
FIG. 5 is an isometric view of a gauging apparatus of the bending press shown in FIGS. 1 and 2 and is shown as viewed from the rear of the bending press.

Referring to FIG. 5, a gauging apparatus 39 is provided behind the ram member 13 in order to position the workpiece W on the lower tool 15 so that desired portions of the workpiece W may be bent by the upper and lower tools 11 and 15. The gauging apparatus 39 comprises a pair of elongated supporting members **41*a* and 41*b* which are horizontally fixed to the backside of the ram member 9 at right angles thereto and in parallel with each other and are provided at their top surfaces with guide rails 43*a* and 43*b*. The gauging apparatus 39 also comprises an elongated carriage member 45 which is horizontally held by a pair of guide rods 47*a* and 47*b* on a pair of slide members 49*a* and 49*b* slidably mounted on the rails 43*a* and 43*b*, respectively. The carriage member 45 is provided at its rear side with a handwheel 51 and it is so arranged as to be adjusted in vertical position along the guide rods 47*a* and 47*b* by rotating the handwheel 51**.

The carriage member 45 of the gauging apparatus 39 is provided at its front side facing toward the ram member 13 with a plurality of slidable carrier members **53*a* and 53*b* carrying gauging stoppers 55*a* and 55*b*, respectively, to which the end of the workpiece W to be bent is applied so as to be positioned on the lower tool 15. The carrier members 53*a* and 53*b* are normally held fixed on the carriage member 45 but can be moved therealong toward and away from each other to adjust the span between the gauging stoppers 55*a* and 55*b* according to the width of the workpiece W to be bent. The gauging stoppers 55*a* and 55*b* are so designed as to be simultaneously changed in height by pneumatic motors 57*a* and 57*b*, respectively, according to the height of the lower tool 15. Also, the slide members 49*a* and 49*b* by which the carriage member 45 is held together with the horizontally gauging stoppers 55*a* and 55*b* are so arranged as to be simultaneously horizontally moved on the guide rails 43*a* and 43*b* toward and away from the ram member 13 by a pair of lead screws 59*a* and 59*b*, respectively. Thus, the gauging stoppers 55*a* and 55*b* can be simultaneously horizontally moved toward and away from the ram member 13 by simultaneously rotating the lead screws 59*a* and 59*b***.

In order to move the gauging stoppers **55*a* and 55*b* simultaneously, the lead screws 59*a* and 59*b* are provided at their rear ends with gears 61*a* and 61*b*, respectively, which are in engagement with gears 63*a* and 63*b*, respectively, of a connecting shaft 65 which is horizontally disposed at right angles to the lead screws 59***a* and 59*b*. The connecting shaft 65 is rotatably disposed at the rear portion of the gauging apparatus 39 in a suitable manner, and it is provided at its end with a gear 67 which is in engagement with a gear 69 of a vertical shaft 71 which is vertically and rotatably disposed at the rear portion of the gauging apparatus 39. The shaft 71 is in axial engagement with an output shaft 73 of a servomotor 75 by a spline arrangement in a manner such that it can be vertically moved together with the gauging apparatus 39 toward and away from the servomotor 75 without being brought out of engagement with the shaft 73 thereof. The servomotor 75 is mounted on a portion of the bending press 1 such as the upright plate 5 by means of a suitable holding member 77, and it is connected to a motor driving means and a detecting means as will be described hereinafter. Also, a pulse recorder 79 is fixed to the rear end of either of the lead screws 59*a* and 59*b*, and it is also connected to the detecting means to which the servomotor 75 is connected as will be described hereinafter. Thus, the lead screws 59*a* and 59*b* are simultaneously rotated by the servomotor 75 by means of the vertical shaft 71 and the connecting shaft 65 to enable the slide members 49*a* and 49*b* to move the gauging stoppers 55*a* and 55*b* toward and away from the ram member 13.

Figure 6:
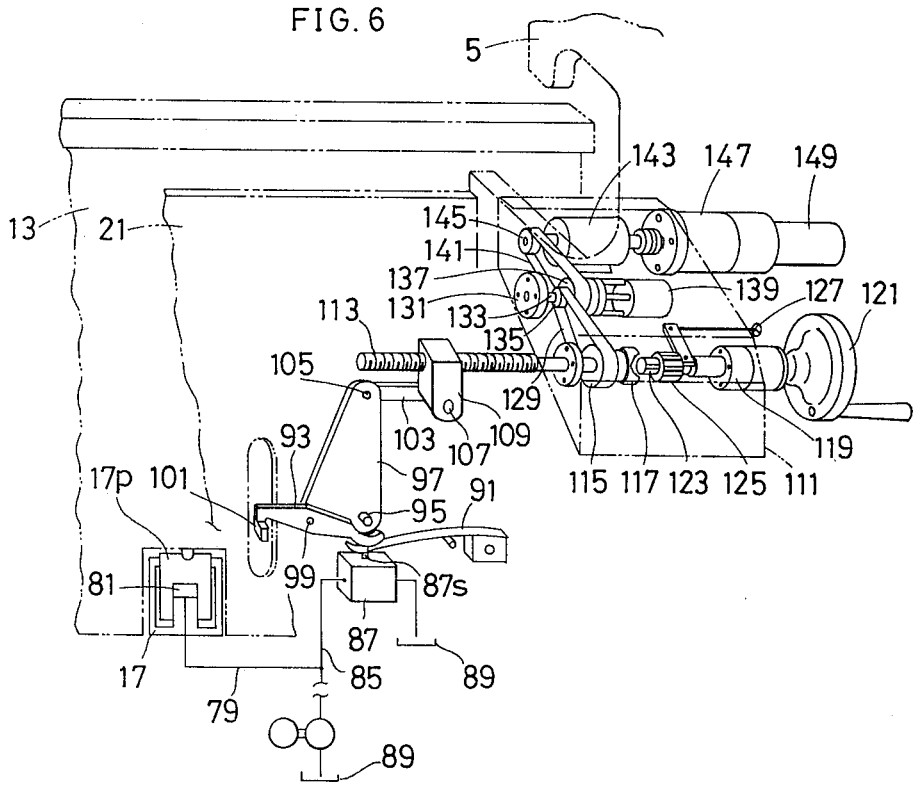
FIG. 6 is an explanatory perspective view of an apparatus for adjusting the stroke length of the ram in the bending press shown in FIGS. 1 and 2 and is shown as viewed from the rear of the bending press.

Referring to FIG. 6, the hydraulic motor 17 for raising the ram member 13 is mounted beneath the ram member 13 with the piston rod 17P connected thereto. Chamber 81 is hydraulically connected by a passage 79 to a hydraulic tank 89. In this arrangement, the hydraulic motor 17 will raise the ram member 13 to bring up the lower tool 15 into engagement with the upper tool 11 when supplied with the hydraulic fluid from the hydraulic tank 89, and also it will enable the ram member 13 to lower by its own gravity when the hydraulic fluid is drained therefrom. Also, the ram member 13 can be stopped at a raised position from lowering by keeping the hydraulic pressure in the chamber 81 of the hydraulic motor 17 in equilibrium with the gravity of the ram member 13 and the bending force by which the workpiece W can be bent. Furthemore, it will be understood that the stroke length of the ram member 13 can be adjusted by controlling the hydraulic pressure of the hydraulic motor 17.

In order to adjust the hydraulic pressure of the hydraulic motor 17, the passage 79 is connected by a passage 85 to an adjusting valve 87 which has a spool member 87S resiliently projecting therefrom. Valve 87 is provided on the backside of the rear plate 21 in the preferred embodiment. The adjusting valve 87 is so arranged so to allow the hydraulic fluid to drain therethrough to the hydraulic tank 89 as the spool member 87S is depressed. Therefore, the hydraulic pressure in the hydraulic motor 17 can be adjusted by depressing the spool member 87S so as to adjust the bending force of the ram member 13.

A spring member 91 such as a leaf spring is provided on the backside of the rear plate 21 in biasing contact with the spool member 87S of the adjusting valve 87. The spring member 91 is stopped from pushing the spool member 87S by its own gravity by a rotatable pin which is fixed to the rear plate 21. A hinge lever 93 is pivotally held in contact with the top surface of the spring member 91 by a hinge pin 99 on a triangular bell crank 97 which is pivotally held by a shaft 95 above the upper portion of the spool 87S at the backside of the rear plate 21. The hinge lever 93 is so disposed as to be contacted by a vertical stopper 101 which is fixed to the backside of the ram member 13 and is rearwardly projecting from the rear plate 21, through a vertically elongated groove formed therethrough. Thus, when the ram member 13 is raised by the hydraulic motor 17, the hinge lever 93 will be upwardly pushed by the stopper 101 and will swing clockwise about the hinge pin 99 secured to the bell crank 97 to push the spool 87S of the adjusting valve 87 downwardly against the spring member 91. Accordingly, the ram member 13 is stopped from rising, since the partial hydraulic fluid delivered from the hydraulic pump is drained into the tank 89 through the adjusting valve 87.

In the above described arrangement, if the bell crank 97 is swung clockwise about the hinge pin 99 when the hinge lever 93 is pushed upwardly by the stopper 101, the hinge lever 93 will be brought up out of contact with the top surface of the stopper 101 to enable the ram member 13 to be raised again, since the spool member 87S of the adjusting valve 87 will upwardly project to block the hydraulic fluid from draining therethrough to the hydraulic tank 89. However, the ram member 13 is stopped again from being raised as soon as the stopper 101 again goes into contact with the hinge lever 93 to enable it to depress the spool member 87S of the adjusting valve 87. Thus, the stroke length of the ram member 13 can be adjusted by adjusting the hinge lever 93 to bend the workpiece W into desired angles.

In order to adjust the stroke length of the ram member 13, an elongated connecting plate 103 is pivotably connected to the bell crank 97 by means of a pin 105 at its one end and it is connected at its other end to a nut 109 by means of a pin 107. The nut 109 is threadedly held by a lead screw 113 horizontally and rotatably to a casing 111 provided at the outside of the upright plate 5, so that the bell crank 97 can be adjusted by rotating the lead screw 113. The lead screw 113 is provided with a pulley 115 and a pipe-like inner gear 117 which is spline-shaped at its inner surface. A shaft 123 having a handwheel 121 is rotatably held by the casing 111 by means of a bearing casing 119 in axial alignment with the lead screw 113 and a spline-shaped outer gear 125 is horizontally slidably provided on the shaft 123 so that it can be slid into and out of engagement with the inner gear 117. The outer gear 125 is so disposed as to be engaged and disengaged with the inner gear 117 when a lever 127 horizontally protruding from the casing 111 is pushed or pulled.

Thus, the bell crank 97 can be adjusted by rotating the handwheel 121 to rotate the lead screw 113 so as to bring the inner gear 117 into engagement with the outer gear 125.

The pulley 115 is connected by an endless belt 129 such as a timing belt to a pulley 135 fixed to a rotatable shaft 133 which is rotatably held by the casing 111 by means of a bearing casing 131. The shaft 133 has a pulley 137 and is connected to a shaft of a pulse recorder 139 mounted in the casing 111. The pulley 137 is connected by an endless belt 141 such as a timing belt to a pulley 145 fixed to an output-shaft of clutch member 143 such as a magnetic clutch, which is mounted in the casing 111. The clutch member 143 is connected with a servo motor 147 which is mounted on the outside of the casing 111 provided with outside tachometer generator 149.

Thus, the rotation of the lead screw 113 can be adjusted by rotating the servo motor 147 via the handwheel 121 and the bell crank 97 can be rotatably adjusted by rotating the lead screw 113 by means of the nut 109. Also, rotative position of the bell crank 97 can be detected by the pulse recorder 139 and can be manually and automatically adjusted thereby. Accordingly, the stroke length of the ram member 13 can be adjusted and the workpiece W can be adjusted. The workpiece W can be easily and accurately bent any angle by controlling the handwheel 121 or the servo motor 147.

In the above described arrangement, the gauging stoppers 55*a* and 55*b* of the gauging apparatus 39 can be accurately moved toward and away from and the lower tool 15 by controlling the servo motor 75 and can be vertically adjusted by controlling the pneumatic motors 57*a* and 57*b*. Also, the stroke length of the ram member 13 can be accurately controlled by controlling the servo motor 147 to bend the workpiece W to any angle.

Figure 7:
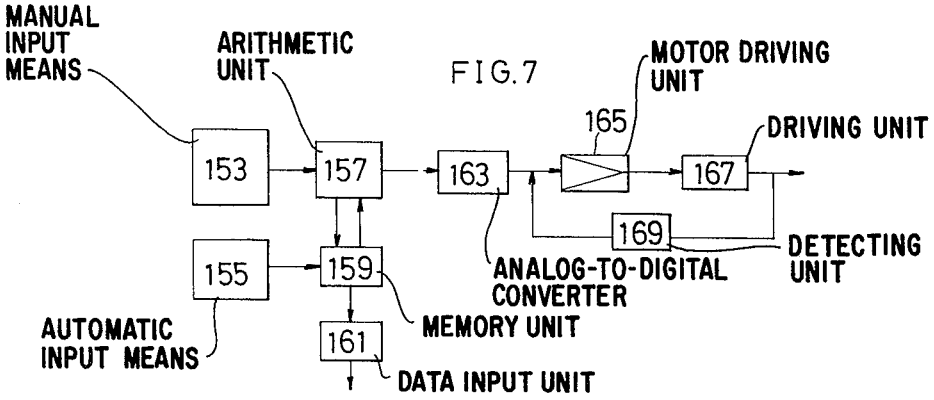
FIG. 7 is a schematic diagram embodying the principles of the present invention.
Figure 8:
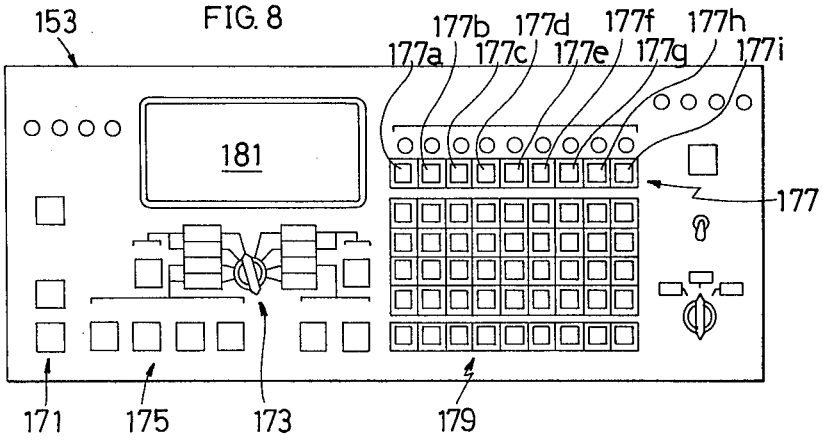
FIG. 8 is a front view of an input apparatus embodying the principles of the present invention.

Referring to FIG. 7, there is shown a schematic diagram of an apparatus for controlling the servomotors 75 and 147. The controlling apparatus comprises a manual input means 153 and an automatic input means 155. The manual input means 153, which is shown as a unit in FIG. 8, is so arranged as to make programs based upon manually entered data such as the width of the bending groove of the lower tool 11, thickness of the workpiece W, bending angle, and width of the workpiece W. The automatic input means 155 is so arranged so to make programs based upon the above data from any input device such as a magnetic tape, card, cassette, dish, and other forms of data input. The data from the manual input means 153 is directly fed into an arithmetic unit 157, and pre-setting data of the automatic input means 155 is fed to the arithmetic unit 157 through the memory unit 159. The stored data of the arithmetic unit 157 can be transferred to a recording means such as a tape through a memory unit 159 and a data output unit 161. The arithmetic unit 157 controls properly entered data fed from the input means 153 and 155 and feeds data to an analog-to-digital convertor 163. Also, the converter 163 controls the entered data fed from the arithmetic unit 157 and controls a driving unit 167 connected to the servomotors 75 and 147 through a motor driving unit 165. The movement of the driving unit 167 is detected and feed-back is controlled by a detecting unit 169 connected to the pulse recorders 77 and 139. Thus, the position of the gauging stoppers 55*a* and 55*b* of the gauging apparatus 39 and the stroke length of the ram member 13 are kept under control of the converter 163 based on the preset data of the input means 153 and 155.

As seen from FIG. 8, the manual input means 153 is provided with switches such as a main switch 171 for the power supply, an eight-position-rotatable mode switch 173, a plurality of speed-selectable switches 175 for selecting speed and direction of the gauging apparatus 39 and the means for adjusting the stroke length of the ram member 13, i.e., a plurality of function keys 177 for selecting various functions such as data setting and many input data keys 179 setting many data. Specifically, the speed selectable switches 175 are so arranged as to select the speed and direction of the gauging apparatus 39 and the means for adjusting the stroke length of the ram member 13 when the rotatable mode switch 173 is so selected as to move the stoppers 55*a* and 55*b* in the gauging apparatus 39 or to adjust the stroke length of the ram member 13 by feeding manually. In the preferred embodiment, the input data can be indicated by the display 181 of the manual input means 153 as shown in FIG. 8. The function keys 177 of the manual input means 153 are provided with the following input keys: process data input key 177*a* of a bending process having a parameter entry which is necessary to determine one action of the process; data display key 177*b* which indicates the above entered data to the display 181; data input key 177*c* setting the process to be made to the workpiece to be bent; modular programming data input key 177*d* setting the secondary function-parameter and the amount of the correction of the above setting process; a workpiece-calling key 177*e* selecting a series of the input data set by the data input key 177*c* and the modular programming data input key 177*d* so as to automatically operate the gauging apparatus 39 and adjust the stroke length of the ram member 13; a display key 177*f* indicating the present position and speed of the stoppers 55*a* and 55*b* of the gauging apparatus 39 and of the ram member 13; a parameter input key 177*g* setting various parameters; a recording start key 177*h* starting the puncher in order to record the needed data into the paper tape; a self-checking key 177*i* indicating the failure-data to the display 181 when the failure occurs in the controlling means 151.

In the above described arrangement, the various data on the bending conditions can be sent to the controlling means 151 by operating and setting the data entry keys of the manual input means 153 in such a manner as to be indicated by the display 181. Thus, the workpiece W can be easily and accurately bent into desired shapes by controlling the travel-movement of the stoppers 55*a* and 55*b* of the gauging apparatus 39 and the upper stroke limit of the ram member 13 by means of the manual input means 153.

Figure 9:
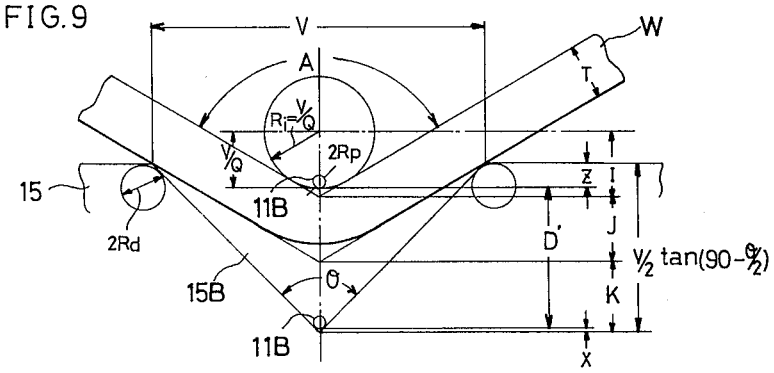
FIGS. 9 and 10 are illustrations showing a bending operation.

Referring to FIG. 9, the workpiece W placed on the lower tool 15 is bent when the lower tool 15 is moved up by the ram member 13 into engagement with the upper tool 11 to enable the bending portion 11B thereof to enter into the groove 15B of the lower tool 15. Therefore, the bending angle A to be made on the workpiece W to be bent can be determined by adjusting the bending depth Z between the top surface of the lower tool 15 and the bottom end of the upper tool 11 entering into the bending groove 15B. However, since the bending depth, namely the distance between the top surface of the lower tool 15 and the bottom end of the upper tool 11, is determined by the original measuring point where the lower tool 15 and the upper tool 11 are in perfect engagement with each other, it is necessary to determine the vertical distance D' between the original measuring point and the bottom end 11B of the upper tool 11. Also, the distance D' should be determined by taking into consideration the very little distance between the bottom end of the bending groove 15B and the bottom end of the upper tool 11 since the bottom end 11B of the upper tool 11 is formed to be slightly semicircular (a radius Rp) in cross section. Furthermore, it is likewise necessary to take into account the radius Rd of the shoulder edges of the bending groove 15B of the lower tool 15 which is also formed to be slightly circular in cross section.

Figure 10:
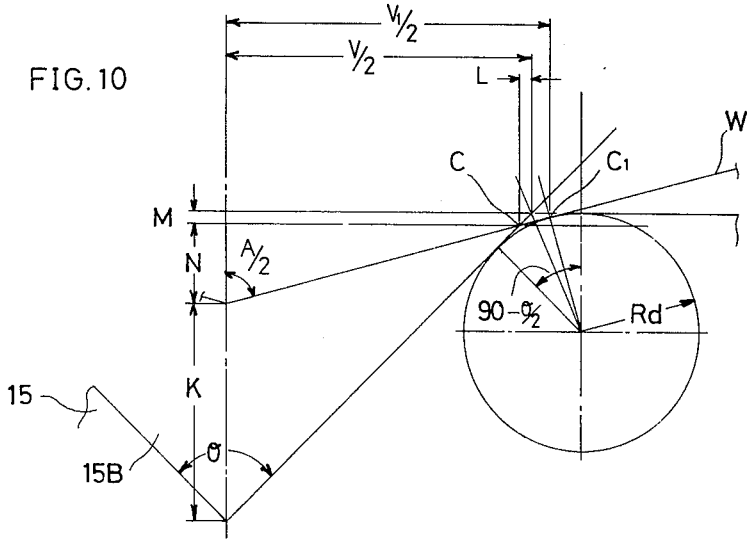

Referring to FIGS. 9 and 10, in order to mathematically describe the principles of the present invention hereinafter, T represents the thickness of the workpiece W to be bent, Ri represents the inner radius in the bending angle A of the workpiece W to be bent, V represents the width of the bending groove 15B of the lower tool 15, $\theta$ represents the angle of the bending groove 15B of the lower tool 15. Also, the various drawing measures are represented by the characters I, J, K, L, M, N.

Ri can be written as $Ri=V/Q$.

The character Q can be expressed as functions such as the width V of the bending groove 15B of the lower tool 15, the thickness T of the workpiece W to be bent, the bending angle A of the workpiece, the tensile strength $\sigma$ of the workpiece W, the coefficient $K_1$ determined by the condition of the cutting edge of the workpiece W as follows:

$$Q = f(V, T, A, \sigma, K_1)$$

The character Q exerts a great influence on the thickness T, the tensile strength $\sigma$ and the coefficient $K_1$ and is determined as a constant if the above conditions are invariable.

Therefore, referring to FIGS. 9 and 10, $$Z + \left(I - \frac{V}{Q}\right) + J + K = \frac{V}{2}\tan\left(90 - \frac{\theta}{2}\right) \quad (1)$$

$$I = \frac{V}{Q} \times \frac{1}{\sin\frac{A}{2}} \quad (2)$$

$$J = \frac{T}{\sin\frac{A}{2}} \quad (3)$$

$$K = \frac{V}{2} \times \tan\left(90 - \frac{\theta}{2}\right) - M - N \quad (4)$$

$$L = \left(\frac{\cos\frac{A+\theta}{4}}{\cos\frac{A-\theta}{4}} - \tan\frac{180-\theta}{4}\right) Rd \quad (5)$$

$$M = \left(1 - \frac{\sin\frac{A+\theta}{4}}{\cos\frac{A-\theta}{4}}\right) Rd \quad (6)$$

From the Expression (5) above, the character N can be obtained as follows;

$$N = \left(\frac{V}{2} - \left(\frac{\cos\frac{A+\theta}{4}}{\cos\frac{A-\theta}{4}} - \tan\frac{180-\theta}{4}\right) Rd\right) \tan\left(90 - \frac{A}{2}\right) \quad (7)$$

By substituting the Expression (6) and (7) for the Expression (4), the character K can be obtained as follows;

$$K = \frac{V}{2}\tan\left(90 - \frac{\theta}{2}\right) - \left(1 - \frac{\sin\frac{A+\theta}{4}}{\cos\frac{A-\theta}{4}}\right) Rd - \left(\frac{V}{2} - \left(\frac{\cos\frac{A+\theta}{4}}{\cos\frac{A-\theta}{4}} - \tan\frac{180-\theta}{4}\right) Rd\right) \tan\left(90 - \frac{A}{2}\right) \quad (8)$$

-continued

On the other hand, the character X can be expressed as follows;

$$X = \left(\frac{1}{\cos\left(90 - \frac{\theta}{2}\right)} - 1\right) Rp \quad (9)$$

And the character D′ can be expressed as $$D' = \frac{V}{2}\tan\left(90 - \frac{\theta}{2}\right) - Z - X$$

Hence, by the Expressions (2), (3) and (8) for the Expression (1) and the Expressions (9), the distance D′ can be obtained as follows;

$$D' = \frac{V}{2}\tan\left(90 - \frac{\theta}{2}\right) - \frac{V}{Q} - \left(\frac{V}{Q} - T\right)\frac{1}{\sin\frac{A}{2}} - \left(1 - \frac{\sin\frac{A+\theta}{4}}{\cos\frac{A-\theta}{4}}\right) Rd - \left(\frac{V}{2} - \frac{\cos\frac{A+\theta}{4}}{\cos\frac{A-\theta}{4}} - \tan\left(\frac{180-\theta}{4}\right) Rd\right) \times \tan\frac{180-A}{2} - \left(\frac{1}{\cos\left(90 - \frac{\theta}{2}\right)} - 1\right) \times Rp \quad (10)$$

Thus, the distance D′ can be expressed as functions as follows;

$$D' = f(T, A, Rd, Rp, V) \quad (11)$$

Thus, the distance D′ can be determined by the controlling means based on the above Expressions by setting the data such as the thickness T of the workpiece W, the bending angle A, the radius Rp of the shoulder edges formed in the bending grooves 15B of the lower tool 15, the width V of the bending grooves 15B and the radius Rp formed at the lower edge 11B of the upper tool 11.

As the above Expression (11) does not consider the primary factor occurring in the bending operation to bend the workpiece W, it is necessary to compensate for the primary factor.

Thus, it is necessary to consider the following compensations:

$\delta_1$: the compensation for the deflection caused by the bending force of the workpiece W which causes the gap or throat of the C-shaped upright plate to widen and for the primary factor of the hydraulic value and the deflection caused by the bending force of the workpiece in the portion where the hydraulic motor by which the ram member 13 is raised is mounted.

$\delta_2$: the compensation in amount to thrust the workpiece W into the lower edge of the bending portion 11B of the upper tool 11.

$\delta_3$: the compensation of the upward and downward deflections caused at any horizontal portions such as the beam member 11 and the ram member 15 by the bending force applied to the workpiece W.

$\delta_4$: the compensation in amount of the elasticity-modification caused by pulling away the bending force.

The above compensations $\delta_1$, $\delta_2$, $\delta_3$ and $\delta_4$ are related to the bending force necessary to bend the workpiece W. The theoretical bending force BF necessary to bend the workpiece W can be expressed as follows;

$$BF = C\sigma T^2 B/V \quad (12)$$

In the Expression (12) above, C represents a constant and B represents the bending length of the workpiece W to be bent. The above constant C can be expressed as functions such as the width V of the bending grooves 15B, the thickness T of the workpiece W, the radius Rd of the shoulder edges, and the coefficient of friction $\mu$ of the shoulder edge, as follows:

$$C = f(V, T, Rd, \mu)$$

In case of bending the workpiece W to 90°, it is well known that the workpiece W on the lower tool 15 is not bent until the bending force reaches a certain value after the workpiece W on the lower tool 15 have been in engagement with the upper tool 11. The bending pressure gradually increases after the bending movement to bend the workpiece W is started. The bending pressure is lowered as the bending angle of the workpiece W becomes sharper to decrease the range between about 130° and 120° and the bending pressure is again increased when the bending angle of the workpiece W comes to range between about 95° and 93°. The bending pressure is rapidly increased when the bending angle reaches 90°. Stated otherwise, the actual bending force to bend the workpiece W differs depending upon bending angles but the actual bending force BF' can be expressed as functions of the width V of the bending groove 15B, the thickness T of the workpiece W and the bending angle A, as follows:

$$BF' = f(V, T, A) \times BF \quad (13)$$

As described, the actual bending force BF' can be obtained by the Expression (13) above or can be obtained by computing based upon the upward deflection of the ram member 13 detected by the deflection detector 31. The actual bending force BF' obtained by the Expression (13) is used in case the upward deflection of the beam member 9 is too little to be detected by the deflection detector 31.

Thus, the compensations $\delta_1$, $\delta_2$, $\delta_3$ and $\delta_4$ can be obtained based on the actual bending force BF'. The compensation $\delta_1$ can be expressed as a function of the actual bending force BF' as follows:

$$\delta_1 = f(BF') \quad (14)$$

The compensation $\delta_2$ can be expressed as a function of the actual bending force BF', the bending length B of the workpiece W and the mechanical primary factor $K_2$ of the presses determined by the structure of the beam member 9 and the ram member 13 as follows:

$$\delta_2 = f(FB', B, \sigma) \quad (15)$$

The compensation $\delta_3$ can be expressed as a function of the actual bending force BF', the bending length B of the workpiece W and the mechanical primary factor $K_2$ of the presses determined by the structure of the beam member 9 and the ram member 13 as follows:

$$\delta_3 = f(BF', B, K_2) \quad (16)$$

The compensation $\delta_4$ can be expressed as a function of the bending angle A, the thickness T of the workpiece W, the width of the bending groove 15B of the lower tool 15, the radius Rp of the upper tool 11. the tensile strength $\delta$ of the workpiece W and the coefficient $K_1$ as follows:

$$\delta_4 = f(A, T, V, \sigma, K, Rp) \quad (17)$$

Thus, in consideration of the primary factor caused by the bending force of the workpiece W, the distance D' between the bottom end 11B of the upper tool 11 and the original measuring point can be expressed as follows;

$$D = D' - (\delta_1 + \delta_2 + \delta_3 + \delta_4) = f(V, T, A, Rd, Rp) - [f(BF') + f(BF', B, \sigma) + f(BF', B, K_2) + F(A, T, V, , K_1)] \quad (18)$$

Also, the Expression (18) above can be expressed as follows:

$$D = f(V, T, A, Rd, Rp) - f(BF', B, , K, A, T, V, K_2)$$

The workpiece W can be automatically bent to any angle by setting various necessary data to bend the workpiece W into controlling means 151 by controlling the manual input means 153 on the automatic input means 155 and the arithmetic control based on the above data. One workpiece can be successively bent into shapes having a plurality of different bending angles and bending lengths and can be automatically bent by setting various data to bend the workpiece even if it is uneven in material.

Figure 11:
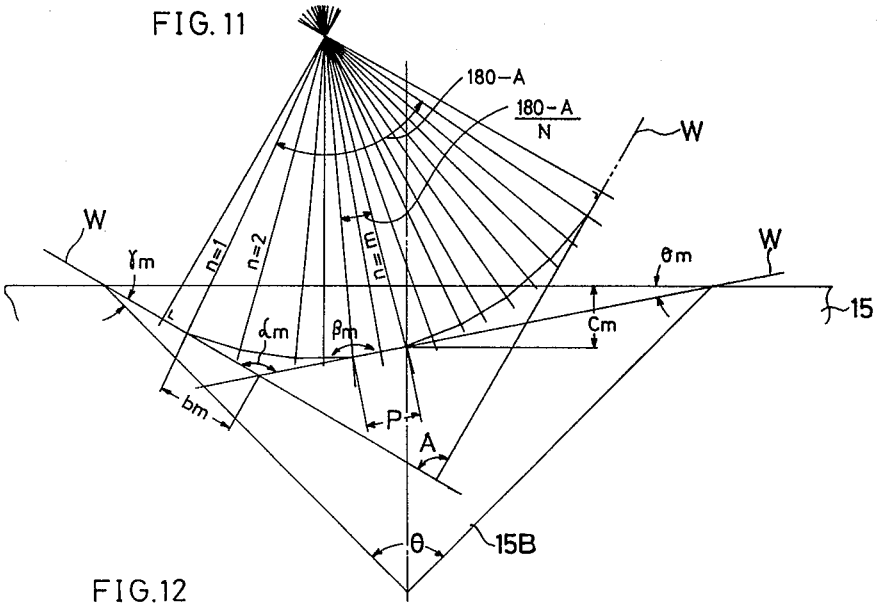
FIG. 11 is an illustration showing a bending of a workpiece into a semicylindrical shape.
Figure 12:
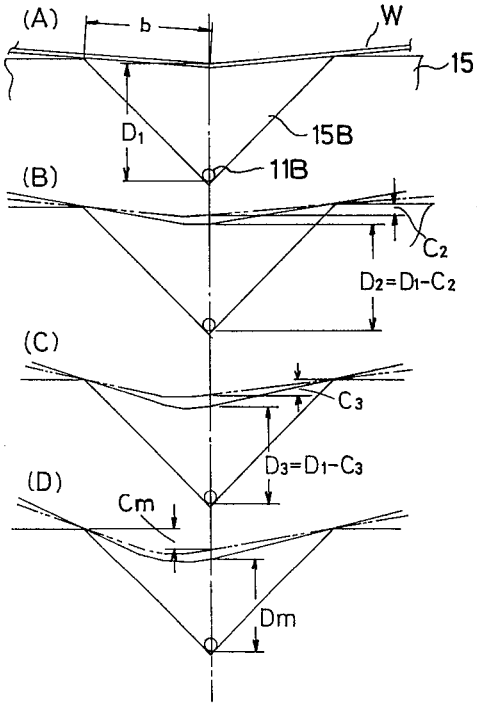
FIGS. 12(A) to (D) are illustrations showing a bending of a workpiece into a semicylindrical shape.
Figure 13:
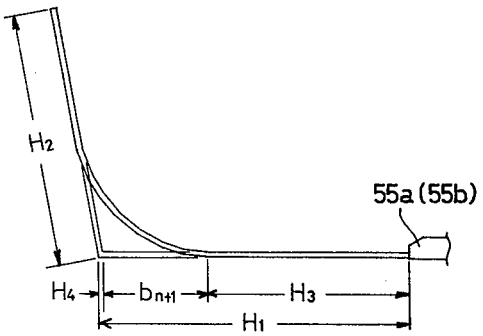
FIG. 13 is an illustration showing a development of a workpiece

Referring to FIGS. 11, 12, and 13 in case of bending the workpiece W into semicylindrical shapes, the workpiece W is first bent with the rear end thereof in contact with the stoppers 55*a* and 55*b* of the gauging apparatus 39 and then, is forwardly moved or fed by a slightest equal distance after each stroke of the ram member 13 with the stroke length thereof adjusted at each stroke. In case of bending the workpiece W to a semicylindrical shape with the radius R and the bending angle A, the developed length L of the semicylindrical shape of the workpiece W can be expressed as functions of the radius R, the bending angle A and the coefficient $K_1$ as follows:

$$L = f(A, R, K_1)$$

Also, the number of the bending operations or the strokes of the ram member 13 can be expressed as follows:

$$n = f(A, R)$$

Furthermore, the pitch P or distance by which the workpiece W is to be moved or fed after each stroke of the ram member 13 can be expressed as follows:

$$P=1/n$$

Thus, the pitch P can be obtained by setting the data entry of the bending angle A, the radius R and the number n of bending operations. To the contrary, the number n of the bending operations can be obtained by setting the data entry of the pitch P, the bending angle A and the radius R. Also, the pitch P can be obtained by storing the controlling means 151 with a definite number of the bending operation, for example 20 times, and setting only data of the bending angle A and the radius R.

Referring to FIG. 12(A), the bending depth $D_1$ by which the workpiece W held by the lower tool 15 is first bent expresses the distance between the bottom end 11B of the upper tool 11 and the original measuring point and, as seen from FIG. 12(B), the bending depth $D_2$ where the workpiece W held by the lower tool 15 is secondly bent can be expressed as follows:

$$D_2=D_1-C_2$$

Referring to FIG. 12(B), the imaginary line shows the workpiece W as first bent and before being forwardly moved to be bent again and the actual line shows the workpiece W as having been bent after being forwardly moved as shown by the imaginary line. Similarly, the bending depth Dm to which workpiece W was bent after m times can be expressed, as seen from FIG. 12(D) as follows:

$$Dm=D_1-Cm$$

Thus, the bending depth Dm between the bottom end 11B of the upper tool 11 and the original measuring point at the m time can be determined by obtaining the distance Dm at the m time and the bending depth can be controlled at each bending time.

As seen from FIG. 12(A), the dimension b represents the distance between the first bending point and the shoulder of the bending groove 15B and it can be expressed as a function of the width $V_1$ of the bending grooves, the bending angle A and the number n of forming operations as follows:

$$b=f(V_1, A, n)$$

Referring to FIG. 11, each angle $\alpha m$, $\beta m$, $\gamma m$ and $\theta m$ at the n time and the dimention bm can be expressed as follows:

$$\alpha m=f(A, m, n)$$

$$\beta m=f(A, m, n)$$

$$\gamma m=f(b, P, bn, V, \alpha m)$$

$$\theta m=180-\gamma m-\alpha m$$

Referring again to FIG. 10, in case of bending the workpiece W at the semicylindrical angle, the distance $V_1$ between the shoulders $C_1$ of the bending groove 15B with which the workpiece W is in engagement is wider than the distance V between the imaginary points C where the bending groove 15B is in contact with the upper surface of the lower tool 15, since the upper portion of the bending groove 15B is formed to be of a semicircular shape with the radius Rd in cross section.

Accordingly the actual engagement width $V_1$ can be expressed as follows:

$$V_1=f(V_1, Rd, \theta)$$

Thus, the distance Cm can be expressed as follows:

$$Cm=f(V_1, \theta m)$$

And the bending depth Dm at the m time can be obtained as follows:

$$Dm=D_1-Cm$$

The first bending depth $D_1$ can be obtained as follows:

$$D_1=f(A, n, V_1, T, \sigma, B)$$

Referring to FIG. 13, the gauging distance $H_1$ between the bending point of the workpiece W and the stoppers 55*a* and 55*b* of the gauging apparatus 39 can be expressed with the dimentions of $H_2$, $H_3$, $H_4$ and bn − 1 as follows:

$$H_1=H_3+bn+1+H_4$$

The dimension $H_4$ can be expressed as a function of the thickness T, the bending angle A and the mechanical primary factor $K_2$ as follows:

$$H_2=f(T, A, K_2)$$

The gauging distance $L_2$ between the first bending point and the stoppers 55*a* and 55*b* is related to the developed dimension kTn of the workpiece W and can be expressed as follows:

$$L_2 = H_3 + \{P(n-1) - \kappa Tn\}$$

$$= H_1 - bn + 1 - f(T, A, K_2) + P(n-1) - \kappa Tn$$

As described above, the gauging distance Cm at the m time can be expressed as follows:

$$Lm=L-P(m-1)-kTm$$

Thus, the developed length Dp of the workpiece W before the bending operation is started can be obtained as follows:

$$Dp=H_1+H_2-f(A, R, T)-P(n-1)1kTn$$

Accordingly, the bending depth Dm and the gauging distance Lm at the m time can be determined by sending various data to the controlling means 151 and operating the arithmetic control by means of the above Expressions. Thus, the workpiece W can be accurately and easily bent to any semicylindrical shape by controlling the stroke length of the ram member 13 and the gauging distance of the gauging apparatus 39 by means of the obtained data. In other words, the workpiece W can be bent to any semicylindrical shape by adjusting the position where the upper tool 11 comes into engagement with the workpiece W.

Although a preferred form of the present invention has been illustrated and described, it should be understood that the device is capable of modification by one skilled in the art without departing from the principles of the invention. Accordingly, the scope of the invention is to be limited only by the claim appended hereto.

We claim:

1. A method of making a V-shaped bend in a workpiece in presses, comprising the steps of:

computing a distance between an original measuring point within bending grooves in a lower tool and a bottom end of an upper tool by using as factors the thickness of the workpiece, bending angle of the workpiece, a radius formed at a shoulder portion of the bending grooves, a radius formed at the bottom end of the upper tool, and a width of the bending grooves;

making a V-shaped bend in a workpiece by bending operations;

computing compensation factors related to the bending forces present in the bending operations from the obtained distance;

computing a second distance between the original measuring point of the bending grooves and the bottom end of the upper tool; and controlling a stroke length of a ram member when the lower tool is in engagement with the upper tool based on the second obtained distance.

2. A method of bending a workpiece into a semicylindrical shape comprising the steps of:

repeatedly stroking a ram member with its stroke length adjusted;

forwardly moving the workpiece by a predetermined distance after each stroke of the ram member;

computing a bending depth at a given time based upon the number of bending operations, said predetermined distance, a bending angle bent to the semicylindrical shape, the thickness of the workpiece, the tensile strength of the workpiece, a bending length of the workpiece, a distance between a first bending point and a shoulder of bending grooves, a width of the bending grooves, a radius of the shoulder of the bending grooves, and an angle of the bending grooves; and computing each stroke length of the ram member in each bending operation based on the obtained bending depth;

whereby the workpiece is bent into the semi-cylindrical shape.

3. The method of claim 2 further comprising the steps of:

computing a bending length between a given bending point and stoppers of the gauging means based upon a bending length between a first bending point and the stoppers, and a predetermined distance; and bending the workpiece to the semicylindrical shape by the subjects of:

controlling each bending length based on the obtained bending length, and repeatedly stroking the ram member with its stroke length adjusted.

4. An apparatus for adjusting a ram for presses having a ram, an upper tool and a lower tool, comprising:

a driving means for raising and lowering the ram.

a means for adjusting the stroke length of the ram for presses by controlling a position for stopping the ram, a means for computing the value of the stroke length of the ram based on entered data including a width of bending grooves of the lower tool, a thickness of a workpiece, a bending length of the workpiece, a tensile strength of the workpiece, a bending angle of the workpiece, a radius of a shoulder portion of the lower tool, a radius of a bottom end of the upper tool and a predetermined constant; and means for controlling said means for adjusting the stroke length of the ram in response to the computed value of the stroke length computed by the computing means.

5. The apparatus as defined in claim 4, further comprising:

means for detecting a deflection of a beam in bending operations to bend the workpiece.

6. The apparatus as defined in claim 4, comprising:

further means for computing the value of the stroke length of the ram after every bending operation based on data on the width of the bending grooves. the thickness of the workpiece, the bending angle of the workpiece, the radius of a semicylindrical bending portion on the upper tool, number of forming operations and a pitch of every bending operation, and further means for controlling the means for adjusting the stroke length of the ram after every bending operation in response to the computed value of the stroke length computed after every bending operation.

7. The apparatus as defined in claim 4, further comprising:

means for computing a distance from stoppers of a gauging means to a forming line of the workpiece based on the entered data, and means for controlling a position of the stoppers of the gauging means based on the computed distance.

8. The method according to claim 2, wherein the computation of said bending depth at a given time is further based upon a distance at the given time.

9. The method according to claim 3, wherein the computation of the bending length between a given bending point and stoppers of the gauging means is further based upon a dimension of a time expansion of the workpiece.

* * * * *

UNITED STATES PATENT AND TRADEMARK OFFICE

CERTIFICATE OF CORRECTION

PATENT NO. : 4,486,841

DATED : December 4, 1984

INVENTOR(S) : Katsumi Koyama, Shigenori Kojima, Tsuneo Kogure, Naoaki Itano; Yoshihiko Ohashi It is certified that error appears in the above—identified patent and that said Letters Patent is hereby corrected as shown below:

Column 18, line 2 -- change "subjects" to --substeps--.

Column 3, line 29, "press," should read -- press --.

Signed and Sealed this

Fourth Day of June 1985

[SEAL]

*Attest:*

DONALD J. QUIGG

*Attesting Officer* *Acting Commissioner of Patents and Trademarks*